US006799622B2

(12) United States Patent
Recchia, Jr.

(10) Patent No.: US 6,799,622 B2
(45) Date of Patent: Oct. 5, 2004

(54) HEAT SEAL DIE FOR HEAT SEALING PLASTIC SHEETS

(76) Inventor: Michael J. Recchia, Jr., 32 W. Schreiber, Roselle, IL (US) 60172

( * ) Notice: Subject to any disclaimer, the term of this patent is extended or adjusted under 35 U.S.C. 154(b) by 0 days.

(21) Appl. No.: 10/225,786

(22) Filed: Aug. 22, 2002

(65) Prior Publication Data

US 2003/0039730 A1 Feb. 27, 2003

Related U.S. Application Data

(60) Continuation-in-part of application No. 09/895,477, filed on Jun. 28, 2001, which is a division of application No. 09/481,211, filed on Jan. 11, 2000, now Pat. No. 6,506,429.

(51) Int. Cl.[7] ..... B65C 65/38; B30B 15/34

(52) U.S. Cl. ..... 156/515; 156/251; 156/308.4; 156/530; 156/583.1; 156/583.2

(58) Field of Search ..... 156/515, 251, 156/308.4, 530, 583.1, 583.4; 493/189, 194, 196, 203, 206, 209; 53/455, 562, 547, 459, 477, 479, 481, 370.4, 373.5, 370.5, 373.4

(56) References Cited

U.S. PATENT DOCUMENTS

| | | | | |
|---|---|---|---|---|
| 1,858,159 A | | 5/1932 | Laymon | |
| 2,085,365 A | | 6/1937 | Israel | |
| 2,347,439 A | | 4/1944 | Shea et al. | |
| 2,349,672 A | | 5/1944 | Nielsen | |
| 2,877,609 A | | 3/1959 | Bodolay et al. | |
| 3,123,279 A | | 3/1964 | Day | |
| 3,257,915 A | | 6/1966 | Cartier et al. | |
| 3,319,538 A | | 5/1967 | Bodolay et al. | |
| 3,498,023 A | | 3/1970 | Reid et al. | |
| 3,552,637 A | | 1/1971 | Swinford | |
| 3,554,368 A | | 1/1971 | Nagel | |
| 3,817,017 A | | 6/1974 | Titchenal | |
| 4,756,144 A | | 7/1988 | Jostler | |
| 4,769,966 A | * | 9/1988 | Petri | 52/716.8 |
| 4,774,797 A | | 10/1988 | Colamussi et al. | |
| 4,804,971 A | * | 2/1989 | Bruns et al. | 343/840 |
| 4,994,137 A | * | 2/1991 | Yanai | 156/515 |
| 5,358,592 A | * | 10/1994 | Fukuyama | 156/361 |
| 5,687,549 A | | 11/1997 | Jostler et al. | |
| 5,771,664 A | | 6/1998 | Recchia | |
| 5,919,504 A | | 7/1999 | Muise et al. | |
| 6,015,373 A | | 1/2000 | Henderson et al. | |
| 6,024,489 A | | 2/2000 | Fox et al. | |
| 6,030,120 A | | 2/2000 | Fox et al. | |
| 6,058,681 A | | 5/2000 | Recchia, Jr. | |
| 6,068,898 A | * | 5/2000 | Oyama | 428/35.2 |
| 6,080,093 A | | 6/2000 | Henderson et al. | |
| 6,190,044 B1 | | 2/2001 | Fox et al. | |
| 6,245,456 B1 | * | 6/2001 | Fukuda et al. | 429/122 |
| 2001/0036496 A1 | * | 11/2001 | Recchia | 426/411 |

FOREIGN PATENT DOCUMENTS

| | | |
|---|---|---|
| EP | 0 677 450 A1 | 4/1995 |
| JP | 402045359 | 2/1990 |
| JP | 405065146 A | 3/1993 |
| JP | 07101720 | 2/1995 |
| JP | 11-130089 | 5/1999 |

* cited by examiner

*Primary Examiner*—Richard Crispino
*Assistant Examiner*—Cheryl N. Hawkins
(74) *Attorney, Agent, or Firm*—Garrettson Ellis; Seyfarth Shaw LLP

(57) ABSTRACT

Bags for produce or the like are prepared by advancing a thermoplastic sheet and a mesh sheet, each having an upper edge, along a process line. The plastic sheet has a bottom portion which is folded to define a lower edge of the thermoplastic sheet at the fold line. One seals the folded portion of the solid-wall thermoplastic sheet to a lower edge of the mesh sheet. Transverse slits are then formed in the sheets, and the sheets are heat sealed together near edges of the slits to form separate bags between the slits. The slits extend across both lower edges of the bags, but are preferably spaced from the upper edges. One drops produce between the sheet upper edges into the bags, and the bags are then heat sealed adjacent to the upper edges thereof, and subsequently separated by cutting. A novel heat seal die is also shown.

25 Claims, 3 Drawing Sheets

10
12
14
16
18
20
22
24
27
28
29
29a
30
30a
31
33
34
36
38
40
42
44
46
50
52
54
56
58
60
62
64

6
6
12
14
18
27
29a
30a
31
33
42
44
46
50
56
60
62
64
70
72
74
76
78
80
82
86
88
90
92

HEAT SEAL DIE FOR HEAT SEALING PLASTIC SHEETS

This is a continuation-in-part of U.S. application Ser. No. 09/895,477, filed on Jun. 28, 2001, which is a divisional application of U.S. application Ser. No. 09/481,211, filed on Jan. 11, 2000 now U.S. Pat. No. 6,506,429.

BACKGROUND OF THE INVENTION

Bodolay et al. U.S. Pat. No. 3, 319, 538 shows a bag making machine comprising a continuous process line for making bags of plastic sheeting by heat sealing and cutting of a continuous length of plastic sheeting. The sheeting is folded longitudinally to define an intact, folded bottom edge. The bags may be filled with produce or the like as they are formed on the process line.

As a later step, the sides of the partially formed bag are simultaneously sealed and cut away, leaving a connected top strip of the plastic, to permit completion of the bag-forming process with a filling and a top-sealing step.

However, technical problems arise as the cutting takes place at or next to the hot, immediately-formed vertical seals. The seals can be damaged by the cutting blade since they are still fresh, hot, and soft, and plastic material can adhere to the blade since it is in viscous, liquid form. The plastic can adhere there, to interfere with the subsequent cutting process of the Bodolay et al. process line.

Furthermore, some bag containers are not suitable for the storage of onions, for example, which require a large degree of air ventilation in order to avoid premature spoiling, so that a bag made out of plastic sheeting on both sides is not suitable for use.

By this invention, a bag is provided which is suitable for the storage of onions and other products where a high degree of open ventilation is necessary or desired, while such a bag may be made on an automated process line from rolls of plastic material. Furthermore, a novel heat seal and cutting die is provided in which the cutting and the heat sealing may be simultaneous, but without the technical difficulties that arise in Bodolay et al. when heat seal lines are formed with a simultaneous cutting step.

DESCRIPTION OF THE INVENTION

By this invention, a process for the manufacture of bags made from plastic sheets is disclosed where, preferably, one side of the bag comprises a mesh sheet, which is typically made out of plastic, and which is heat sealed at its periphery to a solid-wall, thermoplastic sheet to form the complete bag. By the method of this invention, one advances a pair of sheets, one of which is a solid thermoplastic sheet and the other of which comprises a mesh, along a process line. One side of the thermoplastic, solid-wall sheet is folded over on a fold line to engage a corresponding side of the narrower mesh sheet. A longitudinal seal line is formed between them, which seal line is spaced from the fold line. One forms transverse slits in both of the sheets together, and one heat seals the sheets together at edges of the slits to form separate, sealed bag edges. The slits extend across edges of the combined sheets, but are spaced from the opposed, typically upper, edges.

One then drops produce or other desired materials between the open, upper edges of the two sheets. Thereafter, the bags may be heat sealed along the upper sheet edges thereof, preferably by sealing at a point spaced from the upper edges of the sheets of the process line, while cutting a line spaced from the upper edge seal, so that a waste strip of plastic sheeting is retained on the process line, and the bag, comprising a joined mesh sheet wall and solid plastic sheet wall, and sealed at all four sides, drops away.

Preferably, the sealing of the side edges and other edges of the bag may be accomplished by a heat seal die, which comprises first and second heat seal bars for joining the sheets with heat seal lines (both mesh and solid sheets). The bars are spaced from each other in parallel relation, but no more than about two inches apart and preferably less than one inch. A heated cutter edge for cutting aligned, linear cuts in the sheets (mesh and solid) is provided, with the cutter edge being positioned between the heat seal bars. A system is provided for heating the heat seal bars and the cutter edge, each above the softening temperature of at least one of the sheets and preferably both. An anvil is positioned to back the sheets, against which the heat sealing and cutting takes place.

The heat seal bars preferably carry a high-temperature stable anti-adhesive, such as one or more layers of polytetrafluoroethylene (PTFE), to prevent sticking of the plastic sheets to seal bars. Such sheeting may be made of material sold under the trademark Teflon.

Preferably a heater rod extends through a cutter body that defines cutter edge. A major portion of the heater rod is in contact with the cutter body, while a minor portion (typically on the order of about 10% or 20%) of said heater rod is in heat-flow contact with the heat seal bars. Accordingly, a greater heat flow passes to the cutter edge than passes to the seal bars, so that the temperature of the cutter edge is automatically greater than the temperature of the seal bars where they engage the plastic sheets for heat sealing. Thus, the cutter edge is highly effective to make a smooth cut through both sheets, as the seal bars form parallel heat seal lines spaced from the cutter edge.

Preferably, the heat seal bars comprise arms of an integral, U-shaped structure, so that they both may be heated from a single area of contact with the heater rod.

Preferably, the mesh sheeting is positioned so that one set of parallel strands of the mesh extends in the direction of motion of the sheeting along the process line, so that the mesh sheeting is longitudinally stretch-resistant.

The heat sealing and cutting die of this invention simultaneously provides a pair of spaced heat seals to form edges of separate bags, and a cut between the heat seals in the integral sheeting that forms the bag, with the cut being spaced from the respective seal lines so that the hot plastic of the seal lines is not disturbed by the cutting process. Thus, strong, peripheral seals are provided to a continuing series of bags as the manufacture thereof takes place.

A further improvement, which can be used with the heat seal die of this invention described above, or for other, conventional seal bars which are used as heat seal dies to form heat seal lines in thermoplastic materials, is disclosed below.

By this improvement, a heat seal die is provided for heat sealing plastic sheets, which die comprises a heatable heat seal bar having an outer heat sealing edge. A heat conductive metal strip member is carried on the outer heat sealing edge. The heat conductive metal strip member comprises: an elongated base portion and a plurality of spaced apart retention member portions extending in a common transverse direction from longitudinal edges of the base portion.

Inner surfaces of the base portion and the retention member portions define an elongated channel, having an open side opposite to the base portion. The channel grippingly receives the outer heat sealing edge, so that the metal strip member is carried on the heat seal bar, with the base portion of the metal strip member facing outwardly. The retention member portions may have some spring action, so that they may resiliently press against the heat seal bar for frictional retention on the heat seal bar, and they may comprise metal flanges, preferably with some cut spaces along their length and extending normally from the base portion. However, even a simple U channel metal strip member (of U-shaped cross section) may be used if it has suitable resilience.

The metal strip member carries a heat-stable plastic release layer at least on the outer face of the base portion. Thus, sticking of hot plastic to the metal strip member and the heat seal bar during heat sealing is suppressed.

As an added advantage, when the heat stable plastic layer on the base portion has worn out, another heat conductive metal strip member carrying a new plastic layer can be easily placed on the outer heat sealing edge of the heat seal bar. This can avoid an extensive, multiple hour operation in which the heat seal bar itself is replaced, in those circumstances when it is coated with a plastic coating, which is a conventional expedient, and that layer wears out. By the improvement described, the heat seal bar does not need replacement. Instead, an old, worn out heat conductive metal strip member is replaced with a new one, having a fresh, heat-stable plastic layer, for the avoidance of hot plastic sticking to the heat sealed die.

In some desirable embodiments, the retention member portions of the strip member may comprise a plurality of spaced fingers (short flanges) attached to the base portion, in a manner similar to the structure shown in Petri U.S. Pat. No. 4,769,966, which structure is taught to be used for a different purpose. A suitable type of heat conductive metal strip member may be purchased from Device Technologies, Inc. of Marlborough, Mass., which is normally sold for use as a grommet strip for non-molding uses. By this invention, the grommet strip may be encased in a tube of heat-stable plastic, for example, polytetrafluoroethylene, to provide a heat-stable plastic layer for particularly the outer face of the base portion of the grommet strip, which then may be used in accordance with this invention. However, any expedient for placing the plastic layer on the base portion may be used.

Preferably, the heat conductive metal strip member is made of a highly heat conductive metal such as aluminum.

The heat seal bar described above may, in accordance with this invention, be spaced in parallel relation from a second heat seal bar typically by no more than about 2 inches. The heat seal die utilizing the heat seal bar of this invention also may have a heated cutter edge for cutting linear cuts in plastic sheets at a position between the parallel, heat sealed bars. Furthermore, as described above, the heat seal bar may comprise an arm of a U-shaped structure (in cross section) comprising a pair of said heat seal bars.

Alternatively, a conventional, simple, single heat seal bar may also carry the heat conductive metal strip member of this invention having a heat-stable plastic layer, for the purpose of preventing hot plastic sticking during formation of heat seals.

DESCRIPTION OF SPECIFIC EMBODIMENTS

Figures 1, 2, 3:
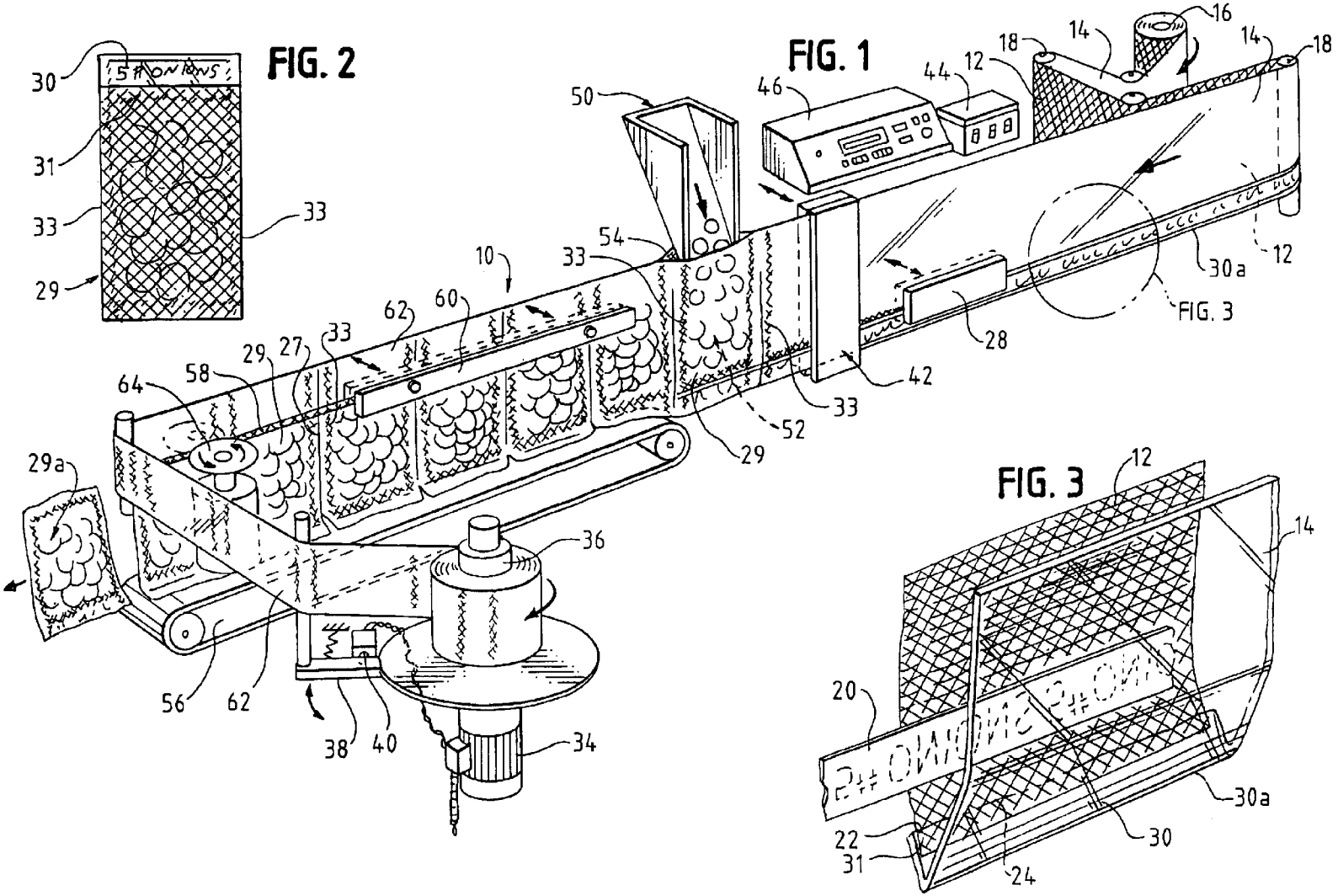
FIG. 1 is perspective view of a process line incorporating the invention of this application.
FIG. 2 shows an individual bag made by the process of FIG. 1 in an inverted form so that the header is on top.
FIG. 3 is a fragmentary, perspective view showing how a label strip or the like can fit within the header as it is being formed.

Referring to the drawings, process line 10 comprises a pair of plastic sheets. One of the plastic sheets is a mesh sheet 12, and the other is a solid, aperture-free plastic sheet 14, shown to be wound together on a spool 16. If desired of course, the sheets in strip form may be drawn off of a pair of separate plastic spools and brought together. The sheets pass along rollers 18, and a strip of paper 20 (FIG. 3) may be placed between them or may be advanced between them, with the paper strip carrying label indicia. Initially, a bottom edge 22 of solid-wall plastic sheet 14 may be pre-folded as wound on spool 16 and pre-sealed to the lower edge 22 of mesh sheet 12. Alternatively, the bottom edge 22 of plastic sheet 14 may be folded upwardly within a folder unit on the process line. The joined sheet or web edges are sealed with a strong heat seal 31 at station 28, as shown particularly in FIG. 5. The location of seal line 31 is also shown in FIG. 3, though at the moment shown the seal 31 has not yet been formed.

The seal 31 is between folded up edge 22 of solid-wall sheeting 14 and the lower edge 24 of mesh sheeting 12, so that a header section 30 is provided where both of the sides of the bag are made of the solid-wall sheeting. Paper indicia strip 20 may fit in there as wound on spool 16 and be sealed, being retained by the fold line 30*a* on one side and the heat seal 31 on the other.

The two sheets 12, 14 on process line 10 are advanced by motor 34, which rotates spool 36. A spring tension arm 38, rotatable and spring-biased at a desired tension, advances the respective strips 12, 14 on the process line as the spool rotates, with tension arm 38 providing a relatively constant tension to the process line to cause advancement. As tension arm swings to its limit of rotation, being driven there by the rotation of spool 36, limit switch 40 senses such motion and shuts off motor 34. Then, the line advances by spring tension, with rotation of arm 38 until it is back to its other limit position rotationally spaced from the limit switch position, and motor 34 is once again turned on to rotationally advance arm 38 again. Thus, continuous operation at relatively constant tension of advancement is provided to the process line.

Figures 4, 5, 6:
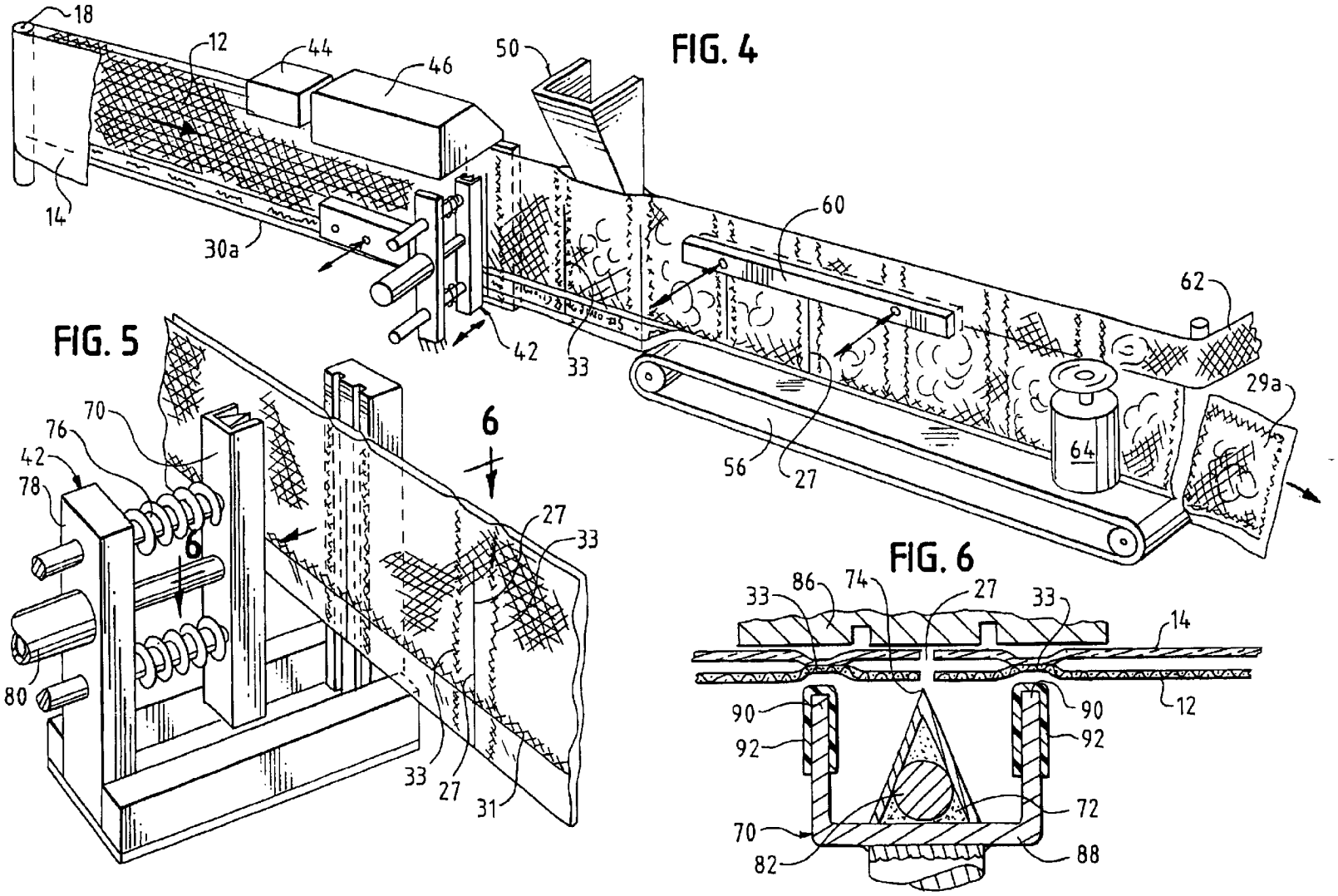
FIG. 4 is a perspective view of the process line of FIG. 1, seen from the other side.
FIG. 5. is a fragmentary, perspective view of the station in the process line of FIG. 4 where vertical bag side seals are formed, and the strip is simultaneously cut, to partially separate the bags from the overall strip, with the portion of the upper lateral portion of the sheeting being broken away.
FIG. 6. is an enlarged, transverse sectional view of the sealer/cutter die used at the sealing station of FIG. 5.

After the formation of the horizontal header seal 31 and the header 30, the two strips or webs of sheeting 12, 14 are advanced to bag side seal station 42. At this station, the sides of the respective bags are defined by vertical seals 33, and the bags are partially separated by cutting of vertical slits 27 (FIG. 6). Controls for the heat sealer station 28 and the sealers and cutter of station 42 may be found in control panels 44, 46, which provide power and operating control to stations 28, 42. Slits and seals 27, 33 are spaced from the upper edges 54 of strips or webs 12, 14.

As the sealed plastic strips or webs 12, 14 move along the process line, they encounter a product chute 50, which connects to a source of the product such as onions. A metered amount of the onions 52 are placed into the newly formed bag 29 between respective vertical seals 33 through the open top of the bag provided by the yet-unsealed upper edges 54 of the respective webs 12, 14.

Then, as the respective webs 12, 14 move farther down the process line, the filled bags 29 are supported by a bottom conveyor belt 56, which moves with the newly formed and filled connected bags 29.

A top horizontal seal 58 is then provided on the process line by horizontal sealer 60. Top seal 58 is spaced from the top edge 54 of the respective webs 12, 14 to preserve a continuous strip 62 above the horizontal top seal 58. This strip 62 is shown in generally enlarged width for clarity of illustration. Practically speaking, it will be narrower than shown for purposes of efficient usage of the plastic strip material. Then, the sealed bags 29 are advanced to a horizontal cutter 64, which forms a cut just above horizontal seals 58, being spaced from sealer 60 so that the seal 58 has a chance to cool and harden before encountering cutter 64. Cutter 64 is positioned to intersect each vertical slit 27, thus separating each filled bag 29*a* from the top web portion 62. Each filled bag 29*a* then falls off the end of bottom support conveyor belt 56 as a finished product.

The top web portion 62 that remains is then wound on spool 36, and provides a recyclable material.

Turning to FIGS. 5 and 6, vertical sealer and cutter member 42 are shown to comprise a heat seal die 70 having an integral heated cutter 72 with a cutter edge 74, mounted on an adjustable shaft arrangement comprising a pair of spring mounted shafts 76 carried in block 78, and operated by conventional, adjustably positionable apparatus permitting the opening and closing of heat seal die 70 for operation. Central tube 80 provides electric cable to heat a heater rod 82, which extends longitudinally within cutter body 72 to provide desired heating to cutter edge 74, so that the vertical cut that is provided to webs 12, 14 is a clean cut as cutter edge 74 cuts the webs and presses against anvil block 86. The respective pairs of heat seal lines 33 that bracket cutter body 72 are formed by a U-shaped heater die 88, having a pair of arms defining outer heat sealing tips 90 for providing heat to the vertical heat seals. The outer ends of arms 90 are encased with typically one or two layers of polytetrafluoroethylene (PTFE) sheeting 92 to serve as a high-temperature-stable, anti-adhesive layer to prevent sticking of plastic sheets 12, 14 to seal bars 90.

Also, it can be seen that a major portion of the circumference of heater bar 82 is in contact with cutter body 72, while only a minor portion 94 of the periphery of heater rod 82, on the order of ten to thirty percent, is in contact with the U-shaped structure 88 comprising the pair of spaced heat seal bars 90. Thus, a greater portion of the heat flowing from heater rod 82 flows into cutter body 72, when compared with the amount of heat that flows into U-shaped body 88 comprising the heat seal dies 90. Accordingly, cutter edge 74 can be of a higher temperature than the corresponding edges of heater die arms 90, so that cutter edge 74 penetrates webs 12, 14 more easily than heat seal die arms 90. Furthermore, the presence of PTFE layers 92 can serve to increase the temperature differential between cutter edge 74 and the temperature encountered at heat seals 33. Then, heater rod 82 can be adjusted to emit heat at such a degree that the desired temperature is provided at heat seals 33, and cutter edge 74 then operates at a significantly higher temperature for better cutting action, while the three members 90, 74 that act upon the plastic sheeting are all heated from a single heater rod 82.

Heat seal die arms 90 may be spaced from each other by about three quarters of an inch, which provides sufficient spacing so that the cutter edge 74 does not interfere with the simultaneous formation of good, uniform heat seals 33.

Thus, a process is provided in which bags having substantially a mesh material on one side and solid-wall sheet on the other are manufactured from a web of each material, being filled on the process line and emerging from the process line in a complete, filled form, ready for sale. Such bags provide a high level of ventilation for product such as onions, while enjoying a highly automated packaging process.

Figure 7:
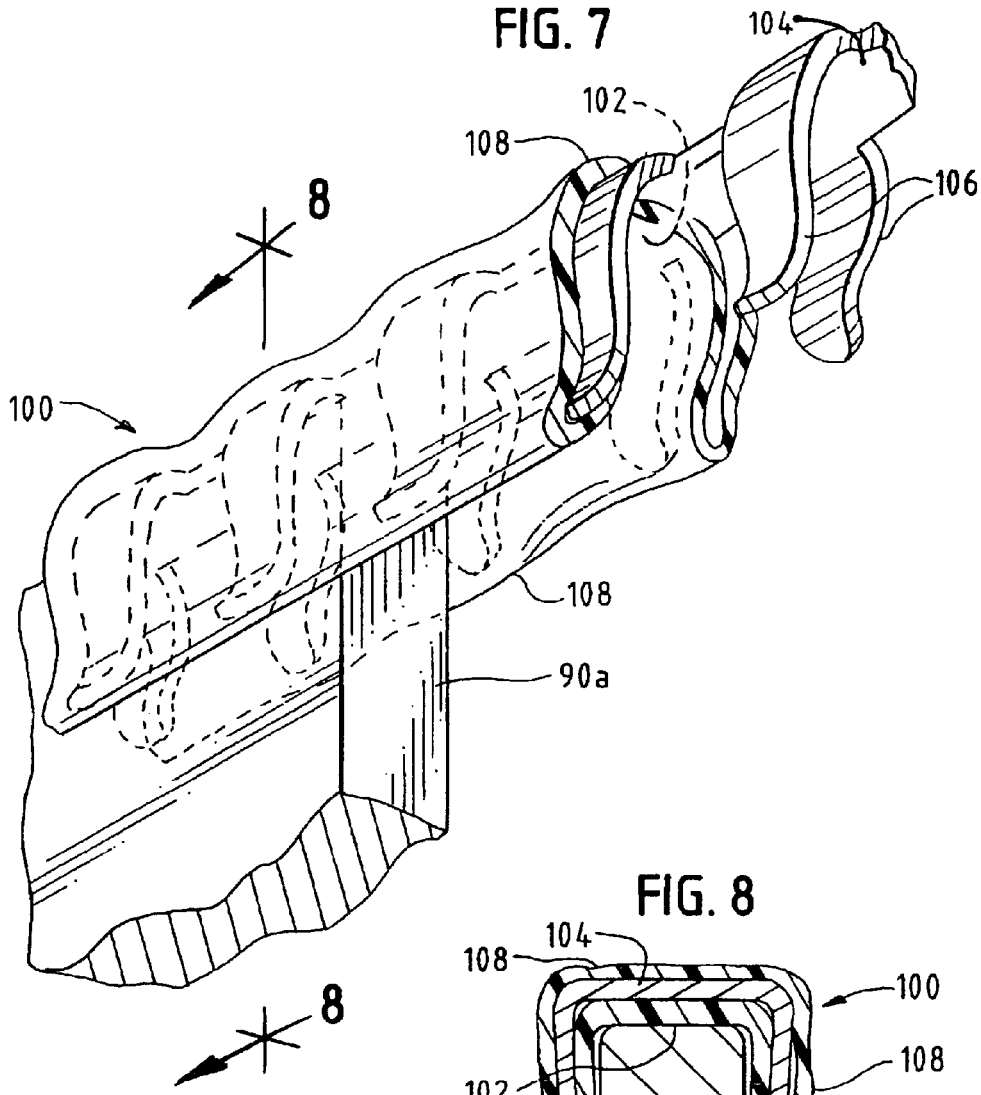
FIG. 7 is a perspective view of a heat seal bar in accordance with this invention, carrying a heat conductive metal strip member with a heat-stable plastic layer, for the purpose of suppressing sticking of hot plastic during heat sealing operations.
Figure 8:
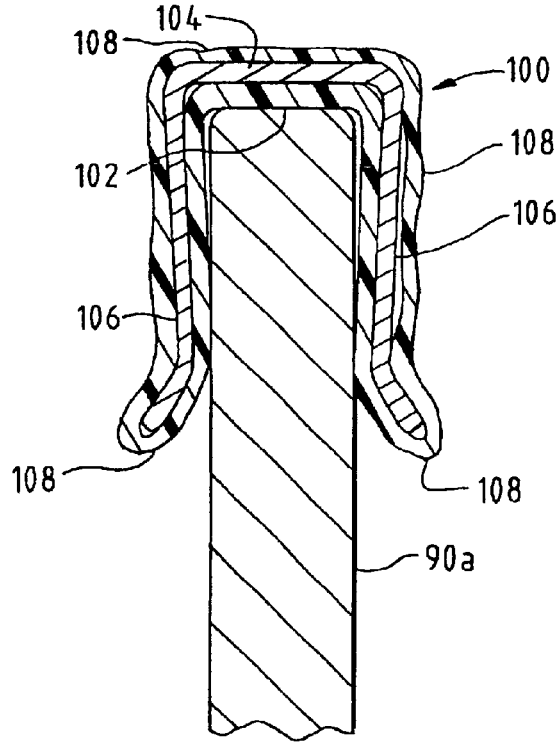
FIG. 8 is a sectional view of FIG. 7 view of the sealing die of FIG. 7, taken along line 8-8.

Referring to FIGS. 7 and 8, an improvement to one or both of the heat seal dies 90, previously disclosed, is shown. While this improvement is shown being used with the particular heat seal die of this invention, it is contemplated that the improvement may also be used in conjunction with essentially any and all heat seal bars and plates used in the prior art.

With a lot of usage, plastic layer 92 of the prior embodiment can wear, so that the heat seal dies 90 must be replaced either for recoating with heat resistant plastic such as PTFE or complete replacement. This can be a job which takes several hours.

In accordance with this invention, a heat seal bar or plate 90 can be covered with a heat resistant plastic layer, while the plastic layer may be easily replaced in a matter of seconds or a minute or two.

Heat conductive metal strip member 100 is shown to be carried on the outer heat sealing edge 102 of a heat seal die 90*a*, which is a flat bar. Heat conductive metal strip member 100 may be made of aluminum, and comprises an elongated base portion 104 and a plurality of spaced apart retention member portions 106 extending in a common transverse direction from longitudinal edges of the base portion. In this embodiment, these retention member portions are fingers 106, which, as shown in FIG. 7, are alternatingly positioned on opposite sides of heat seal die 90*a*. Thus, heat seal die 90*a* has its outer end 102 covered by the strip member 100, which is of U-shaped cross section, with fingers 106 being displaced by spring action to frictionally hold strip member 100 in the desired position.

Strip member 100 is sheathed in a tube of PTFE film 108, which is shown to be collapsed into U-shaped cross section as well, completely sheathing and covering the side surfaces of metal strip member 100, and providing the outer end of heat seal die 90 with a surface of PTFE film 108, so that adhesion of softened, hot plastic to die bar 90*a* is strongly suppressed by the presence of the PTFE film 108. Metal strip member 100 serves to retain PTFE film 108 in the desired position to prevent softened, hot plastic adhesion, since softened, hot plastic is typically resistant to adhesion to PTFE.

Then, when PTFE layer 108 has worn out, ruptured or the like, heat conductive metal strip member 100 is simply pulled off of heat seal die 90, and a new, similar metal strip member, similarly sheathed in PTFE, is quickly placed onto the outer end 102 of heat seal die 90*a*. Thus, hours of replacement labor on a process line may be saved.

The above has been offered for illustrative purposes only, and is not intended to limit the scope of the invention of this application, which is as defined in the claims below.

That which is claimed:

1. A heat seal die for heat sealing plastic sheets, which comprises:

first and second heat seal bars for forming heat seal lines in at least one plastic sheet, said bars being spaced in parallel relation from each other but no more than about two inches apart; a heated cutter edge for cutting linear cuts in said plastic sheet, said cutter edge being positioned between said heat seal bars; a system for heating said heat seal bars and cutter edge above the softening temperature of at least one of the sheets being sealed; and an anvil positioned to back said plastic sheet as heat sealing and cutting takes place; and further in which a heater rod extends through a cutter body that defines said cutter edge, a larger portion of said heater rod being in contact with said cutter body and a lesser portion of said heater rod being in contact with said heat seal bars, whereby the temperature of said cutter edge is greater than the temperature of said heat seal bars where they engage the plastic sheets.

2. The heat seal die of claim 1 in which said heat seal bars carry a high-temperature-stable, anti-adhesive layer to prevent sticking of said plastic sheets to said seal bars.

3. The heat seal die of claim 1 in which said heat seal bars comprise arms of integral, U-shaped structure in cross section.

4. The heat seal die of claim 1 in which said heat seal bars and anvil are adjustably positionable relative to each other.

5. The heat seal die of claim 3 in which said heat seal bars and anvil are adjustably positionable relative to each other.

6. A heat seal die for heat sealing plastic sheets, which comprises a heatable heat seal bar having an outer heat sealing edge, and a heat conductive metal strip member carried on said outer heat sealing edge, said strip member comprising:

an elongated base portion and a plurality of spaced apart retention member portions extending in a common transverse direction from longitudinal edges of said base portion;

inner surfaces of said base portion and retention member portions forming an elongated channel having an open side opposite to the base portion, said channel grippingly receiving said outer, heat sealing edge so that the metal strip member is carried on the heat seal bar with the base portion of the metal strip member facing outwardly, said metal strip member carrying a heat-stable plastic release layer on the outer face of the base portion, whereby sticking of hot plastic to the metal strip member and heat seal bar during heat sealing is suppressed.

7. The heat seal die of claim 6 in which said retention member portions comprise a plurality of spaced fingers attached to the base portion.

8. The heat seal die of claim 6 in which said heat conductive metal strip member resides within a flexible tube of said heat-stable plastic, to provide said heat stable plastic layer.

9. The heat seal die of claim 6 in which said heat conductive metal strip member is made of aluminum.

10. The heat seal die of claim 6 in which said heat seal bar is spaced in parallel relation to a second heat seal bar by no more than about two inches, said die also having a heated cutter edge for cutting linear cuts in plastic sheets positioned between said parallel heat seal bars.

11. The heat seal die of claim 6 which said heat seal bar comprises an arm of a U-shaped structure (in cross section) comprising a pair of said heat seal bars.

12. The heat seal die of claim 7 which said heat conductive metal strip member resides within a flexible tube of said heat-stable plastic, to provide said heat stable plastic layer.

13. The heat seal die of claim 12 in which said heat conductive metal strip member is made of aluminum.

14. The heat seal die of claim 13 in which said heat seal bar is spaced in parallel relation to a second heat seal bar by no more than about two inches, said die also having a heated cutter edge for cutting linear cuts in plastic sheets positioned between said parallel heat seal bars.

15. The heat seal die of claim 14 which said heat seal bar comprises an arm of a U-shaped structure (in cross section) comprising a pair of said heat seal bars.

16. The heat seal die of claim 6 which said heat-stable plastic release layer comprises a fluorinated plastic.

17. A heat seal die for heat sealing plastic sheets, which comprises a heatable heat seal bar having an outer heat sealing edge, and a heat conductive metal strip member carried on said outer heat sealing edge, said strip member comprising:

an elongated base portion and a plurality of spaced apart retention member portions extending in a common transverse direction from longitudinal edges of said base portion;

inner surfaces of said base portion and retention member portions forming an elongated channel having an open side opposite to the base portion, said channel grippingly receiving said outer, heat sealing edge so that the metal strip member is carried on the heat seal bar with the base portion of the metal strip member facing outwardly, said metal strip member residing within a flexible tube of a heat stable plastic having release characteristics, whereby sticking of hot plastic of the plastic sheets to the metal strip member and heat seal bar during heat sealing is suppressed.

18. The heat seal die of claim 17 in which said retention member portions comprise a plurality of spaced fingers attached to the base portion, and said flexible tube of heat stable plastic assumes a U-shaped cross section around said spaced fingers and base portion.

19. The heat seal die of claim 17 which said plastic is a fluorinated plastic.

20. The heat seal die of claim 1 in which said first and second heat seal bars each carry a heat conductive metal strip member carried on an outer heat sealing edge of at least one of said bars, said strip member comprising:

an elongated base portion and a plurality of spaced apart retention member portions extending in a common transverse direction from longitudinal edges of said base portion; inner surfaces of said base portion and retention member portions forming an elongated channel having an open side opposite to the base portion, said channel grippingly receiving said outer heat sealing edge so that the metal strip member is carried on the heat seal bar with the base portion of the metal strip member facing outwardly, said metal strip member residing within a flexible tube of said heat-stable plastic, to provide said heat stable plastic layer, said tube of heat stable plastic assuming a U-shaped cross section around said metal strip member as said metal strip member is carried on the outer heat sealing edge of a heat seal bar, whereby sticking of hot plastic to the metal strip member and the heat seal bar during heat sealing is suppressed.

21. An anti-stick aid for use on heat seal bars for the heat sealing of plastic tubing and sheeting, comprising;

an elongated base portion and a plurality of spaced apart retention member portions extending in a common transverse direction from longitudinal edges of the base portion; inner surfaces of the base portion and retention member portions forming an elongated channel having an open side opposite to the base portion, said channel being proportioned to grippingly receive an outer edge of a heat sealing bar so that the metal strip member is carried on the heat seal bar with the base portion of the metal strip member facing outwardly; said metal strip member being within a flexible tube of heat stable plastic, having release characteristics, to provide a heat stable plastic layer that resides against an outer surface of said base portion, said tube of heat stable plastic being capable of assuming a U-shaped cross section around said metal strip member as the metal strip member is carried on an outer edge of a heat seal bar, whereby sticking of hot plastic to the metal strip member and the heat seal bar during heat sealing is suppressed.

22. The device of claim 21 in which said retention member portions comprise a plurality of spaced fingers attached to the base portion, said flexible tube of heat stable plastic assuming said U-shaped cross section around said spaced fingers and base portion.

23. The heat seal die of claim 22 in which said tube of plastic is a fluorinated plastic.

24. The device of claim 23 in which said tube of plastic consists essentially of polytetrafluoroethylene.

25. The device of claim 21 in which said plastic is a fluorinated plastic.

* * * * *